United States Patent [19]

Fujiyama et al.

[11] Patent Number: 4,515,406

[45] Date of Patent: May 7, 1985

[54] HEADREST FOR MEDICAL TREATMENT CHAIR

[75] Inventors: Kunio Fujiyama; Kei Okamoto, both of Osaka; Noriyuki Yoshikawa, Ueno, all of Japan

[73] Assignee: Takara Company, New York, Inc., Somerset, N.J.

[21] Appl. No.: 425,310

[22] Filed: Sep. 28, 1982

[51] Int. Cl.[3] ..... A61G 15/00; A47C 7/38

[52] U.S. Cl. ..... 297/409; 297/391

[58] Field of Search ..... 297/391, 408–410, 297/61, 404, 330, 429–431; 5/72, 79; 248/631

[56] References Cited

U.S. PATENT DOCUMENTS

| | | | |
|---|---|---|---|
| Re. 25,375 | 4/1963 | Lorenz | 297/61 |
| 1,929,023 | 10/1933 | Hickman | 248/631 X |
| 2,481,133 | 9/1949 | Lukeba | 297/330 X |
| 2,921,621 | 1/1960 | Williams et al. | 297/330 X |
| 3,027,194 | 3/1962 | Rumptz | 297/361 X |
| 3,828,694 | 8/1974 | Nestler et al. | 248/631 X |
| 3,836,197 | 9/1974 | Goff et al. | 297/391 |
| 4,082,354 | 4/1978 | Renner et al. | 297/410 |
| 4,215,680 | 8/1980 | Okuda | 297/61 X |
| 4,285,545 | 8/1981 | Protz | 297/410 X |

*Primary Examiner*—William E. Lyddane

*Assistant Examiner*—Peter R. Brown

*Attorney, Agent, or Firm*—Stephen E. Feldman; Nikolay Parada

[57] ABSTRACT

A chair for human dental or medical treatment and having an improved adjustable headrest support. The chair features a flat curved linear strip member which extends between the headrest and the main frame of the chair. The strip member is guided by at least one, and preferably two pairs of opposed cylindrical guide rollers which contiguously straddle the strip member, so as to guide the motion of the strip member along its longitudinal axis, as it is displaced along its axis and towards or away from the frame, typically by a hydraulic mechanism. This makes possible vertical direction of movement of the strip member. The hydraulic mechanism, or two mechanisms in tandem, are a pivoted floating mounting for the strip member which facilitates ready adjustment of the headrest support relative to the main frame and seat of the chair. At least one tension spring is provided to produce smooth backdown of the piston plunger and piston head when hydraulic fluid pressure in the cylinder is reduced. The uses for the present chair and integral headrest configuration include human dental, medical, beauty parlor, and barber shop treatment facilities and installations.

10 Claims, 3 Drawing Figures

R
III
III

HEADREST FOR MEDICAL TREATMENT CHAIR

BACKGROUND OF THE INVENTION

1. Field of the Invention

An adjustable chair for human dental or medical treatment, beauty parlors, barber shops, or the like.

2. Description of the Prior Art

As is generally known, almost all of dental treatments today are with the patient being treated in lying position. That means that the lying position is easier for treatment than is sitting up position, and is also comfortable for the patient as well; yet, a complete satisfaction was still unobtainable with the conventional chair.

That is, in the conventional chair, the headrest was being set up so as to make its expansion and contraction possible to the vertical direction of the headrest with a supporting plate, and the lower part of headrest as its supporting point, was being set up so as to make its angle of elevation of movement possible. And, when working on the upper or the lower row of dental arch while the patient in lying position, the headrest had to be moved all the way to the front or to the back so to facilitate the treatment; in such case, however, that in the aforementioned conventional method, since there occurred a difference between the supporting point of the movement of angle of elevation of the headrest and the supporting point of the movement of the same direction of the patient's head, the cervical vertebrae made a large unnatural bent, and in addition, such position, though depending upon the nature of treatment, had to be maintained somewhere from several minutes to 20 or even more minutes. Therefore, it might have been easier for the treatment, but certainly was undesirable as far as the comfort of the patient was concerned.

The prior art includes motor driven configurations, for adjusting the components of a dentist's chair relative to one another. Typical of the prior art is U.S. Pat. No. 3,027,194 which discloses a headrest with a curved shank that has several dimples formed therein. The dimples cooperate with spring-loaded balls, to define the locked position for the headrest relative to a vehicle seat. U.S. Pat. No. 3,542,428 discloses an adjustable headrest which has a curved linear member, that enables the same to be adjusted relative to the back of an automotive seat. Other prior art of interest includes U.S. Pat. Nos. 694,683; 910,357; 2,481,133; 2,987,116; 3,578,379 and 3,836,197.

SUMMARY OF THE INVENTION

1. Purposes of the Invention

It is an object of the present invention to provide an improved headrest for a medical (or dental) treatment chair.

Another object is to provide an improved chair for human dental or medical treatment and having an improved adjustable headrest support.

A further object is to provide a pivoted floating mounting for a strip member which extends from the main frame of the chair to the headrest.

An additional object is to provide guide rollers for the circular arc strip member, which make possible the vertical direction of movement of the strip member and headrest.

An object is to provide a headrest for a medical or dental treatment chair capable of facilitating the treatment in various ways for doctors and nurses of the physician side, and for the patient, by setting up the angle of elevation of the headrest to a desired degree, with a headrest supporting plate formed into a circular arc, so to facilitate the upper and the lower rows of dental arch treatment while comfortable in lying position, and for having formed the headrest supporting plate with the cervical vertebrae of patient as its virtual supporting point, the aforementioned angle of elevation became greater, and thereby not inflicting any discomfort to the patient, even if a certain position be retained for a longer period of time.

Another object of this invention is in providing a headrest for medical or dental treatment chair capable of facilitating the operation and also stopping firmly at desired position, for having made the aforementioned headrest supporting plate capable of operating by an oil pressure cylinder, i.e. a hydraulic mechanism.

Another object of this invention is in providing a headrest for medical or dental treatment chair which is capable of adjusting to the height or size of the patient.

These and other objects and advantages of the present invention will become evident from the description which follows.

2. Brief Description of the Invention

This invention was developed especially for the purpose of dental treatment; however, it also is applicable to other fields of medical treatments such as otorhinolaryngology and ophthalmology as well, and relates to a headrest for a medical treatment chair. Therefore, it will be understood that within the context of the present invention, the present chair device is applicable to both dental and medical treatments per se, and it will be understood that the invention encompasses and includes all these various methods of treatment known to the various medical arts, including dentistry, which are practiced in a chair or in which the human patient is treated in a chair.

Basically, the present invention is directed to a headrest for medical treatment chair constructed by setting up an oil pressure cylinder for headrest to backrest foundation plate, and to the plunger of oil pressure of the said headrest, the cervical vertebrae of patient as its virtual supporting point, a headrest supporting plate formed into a circular arc is set up, making the vertical direction of movement possible with guide rollers. Within this general arrangement, a preferred configuration is one in which a vertical motion race which makes vertical movement by an oil pressure for the vertical motion race is set up to the backrest supporting plate, and to the said vertical motion race, an oil pressure cylinder for the headrest is set up.

Being constructed as mentioned above, this device has various merits. For doctors and nurses, from the physician's or dentist's viewpoint, it facilitates the treatment in various ways, and for the patient, in order to facilitate the upper and the lower rows of dental arch treatment while being comfortable in the lying position, by setting the angle of the headrest's elevation to a certain desired degree through headrest supporting plate with circular arc, at the same time, the headrest supporting plate is formed the cervical vertebrae of patient as its virtual supporting point "R". The aforementioned angle of elevation became greater. Therefore, it inflicts no discomfort to the patient even if a certain position be retained for a longer period of time; for having constructed the headrest supporting plate capable of operating by an oil pressure cylinder, it facilitates the operation and, at the same time, can stop at a desired position firmly. In other words, the position facilitating the treatment can be maintained at indefinite steps, and from the related construction of vertical motion race and the oil pressure cylinder for the vertical motion race, it is capable of adjusting to the height or size of the patient.

Thus in summary, the present invention entails a chair for dental or medical treatment having an improved adjustable headrest support. The chair features a flat curved linear strip member, which extends between the headrest and the main frame of the chair. The strip member is guided by at least one, and preferably two, pairs of opposed cylindrical guide rollers, which contiguously straddle the strip member, so as to guide the motion of the strip member along its longitudinal axis, as it is displaced along its axis and towards or away from the frame, typically by a hydraulic mechanism. This makes possible a vertical direction of movement of the strip member. The hydraulic mechanism, or two mechanisms in tandem, are a pivoted floating mounting for the strip member which facilitates ready adjustment of the headrest support relative to the main frame and seat of the chair. At least one tension spring is provided, to produce smooth backdown of the piston plunger and piston head, when hydraulic fluid pressure in the cylinder is reduced. The uses for the present chair and integral headrest configuration include human dental, medical, beauty parlor, and barber shop treatment facilities and installations.

The present chair and integral headrest configuration stresses the importance of the natural movement of the doctor, dentist, beauty parlor operator (such as a hairdresser), or barber, and that of the patient or person undergoing the treatment, whatever it may be. It was determined that the pivot of rotation, e.g. axis, is being disposed in the body of the patient or person. Consequently, the natural movement of the doctor, dentist, etc., has become as natural as this pivot of rotation or axis of the patient or person being treated.

The life of a dental chair as a dental treatment facility depends on the headrest supporting the patient's head. The most ideal headrest is one which enables the doctor to obtain a wider view of inside of the mouth for performing the treatment in the most natural position. And for the patient, it is one which enables him to open his mouth with ease for the treatment in a comfortable position. It is important that these two points be met satisfactorily.

With these two points of interest as its basic proposition, and as a first step, an analysis was made of the patient's head and neck movement. The study and analysis were conducted from various angles. As a result, the Axis 1, the supporting point which rotates and which most closely resembles the human neck movement, was discovered. The invention of the present headrest, with the Axis 1 at its center, and which turns by just one switch, has solved the two propositions outlined supra in one new development.

Furthermore, together with the Axis 2, the supporting point of the rotation of the backrest, which resembles most closely the hip movement, the present invention facilitates a natural movement of the doctor and patient, and enables this natural movement to be accomplished so that not only the doctor or dentist or the like, but also the patient, will be satisfied with the present chair and integral headrest configuration. To reiterate, the Axis 1 is the supporting point of rotation of the headrest, resembling the patient's neck movement. Axis 2 is the supporting point of rotation of the backrest, resembling the patient's hip movement, when being raised or laid down. Any position the doctor or dentist desires can be obtained by just one switch. No eye and hand movement of the doctor or dentist or the like is wasted, no mouth or other bodily movement of the patient is wasted, and yet the position is not unnatural. As an objective, it was endeavored to achieve and pursue a configuration aimed at the doctor's and patient's natural positions, and consequently the present chair and integral headrest configuration was developed and brought to completion. The doctor (or dentist) can now obtain any position necessary for performing the treatment by one switch. Thus, the present chair and integral headrest configuration, as contemplated and described, and as claimed infra, represents an advance in the art of dental chairs, and is designed so as to accommodate and adapt to the doctor or dentist by uniting the patient and the Axis as one. The present configuration anticipates future developments, and represents a conclusion form as to such chairs with integral headrest. The present chair in practice is bolstered and made most operable and efficient by electric-powered oil pressure and electronic technologies.

To review the advantages of the present chair and integral headrest configuration, at the onset, the axis-power headrest can obtain a wider view of the inside of the mouth. In addition, the doctor can now perform the treatment in a comfortable position, while looking in directly. Other advantages include that for the first time, the headrest is electric-powered. In addition, since the power headrest is an Axis system whose supporting point of the rotation is being set in the patient's neck, the movement is exceedingly natural and smooth. Now that the patient can open his mouth wide with ease, the doctor's assuming of an unnatural position and unconscious shifting of the body become much less while he (the doctor) is looking in directly.

Another advantage is that the up and down adjustment of the headrest is also done by switch. The electric-powered oil pressure system enables the up and down adjustment of the headrest to unlimited levels by one switch. The operation has become simple. Just put the headrest against the patient's head, and there is no troublesome adjustment of the head slippage to be made caused by the rotation.

Typically, an X-ray showing the enlarged view of inside of the mouth shows a picture of the upper molar area, where in the past was difficult for the doctor to look in directly in the natural position while he was performing the treatment and while watching the patient's jaw relations. The area is now easier to look in by merely changing the angle of the headrest. In other words, the angle of the headrest's movement is less than in the past. In addition, the angle of the occlusion plane is turned to the rear to a different extent than in the past.

Other advantages include the fact that the margin of angle of the opening mouth is larger than in the past. Also, the back of the head points at the head supporting plane are approximately constant. The back of the head points of the past have shifted.

From the result mentioned above, the Axis Power headrest can be said to provide the following new results:

In spite of the consideration that the confines of the headrest's movement is less than what it used to be, the patient is able to open his mouth wide with ease.

When looked in directly in the natural position, not only the views of the upper molars and upper incisors on the tongue side, but also a wider view of inside of the mouth, can be obtained.

Even if the angle of the headrest is to be changed, hardly any slippage between the head and the headrest occurs. Even when the backrest is laid down, the head slippage hardly ever occurs in the present Axis design. The movement of the axis backrest also causes hardly any back slippage. The supporting point of the rotation of the axis backrest, being set in the patient's hip, is the Axis 2. The movement of the backrest in the present Axis design is made by the guide of a circular arc at the lower end of the backrest, rotating with the Axis 2 as its center. The back slippage, and the slippage between the headrest and the head due to raising and lowering of the backrest, occur much less frequently. The design of the seat also strives for fitting of the patient's hip.

Other considerations include the fact that according to the frequency of usage and the hand movement of the doctor, the present Axis control zones are arranged functionally. Thus, a #1-Control Switch (Top Mount Section), which is a control switch that is high in frequency of usage for top mount which the doctor can operate with facility, is installed. It is easily recognizable, and therefore it prevents operational error. Also, the present development features a #2-Control Switch (Elbowrest Section); the angle of the backrest and the up and down of the base can be operated either from the doctor's or the assistant's side. The following switches are typically provided:

1. auto-return switch
2&3. position pre-set switch
4. headrest up and down switch
5. headrest turning switch
6. backrest reclining switch
7. base up and down switch.

A further advantage is that in the present chair and integral headrest configuration, correct operation by one switch is accomplished in the present axis treatment approach as follows:

By one up and down switch of the headrest, the sitting height of the patient can be adjusted.

By one pre-set switch, the 2 memories of treatment position can be obtained.

By one headrest turning switch, a wide view of the mouth can be obtained for performing of the treatment.

With regard to the 2-position Electron Memory System, for the pre-set, the 1C Window Comparator system, capable of obtaining correct memory, is employed. A Foot Switch (option) allows the up and down of the base and the angle of the backrest to be operated by foot. With regard to the backrest, the reverse side of the backrest is designed slimly, slanting the sides. It is designed so that approaching the patient can be made with ease. As for the armrest, since the right side of the armrest opens at its side, in and out entry or egress of the patient can be made with ease. There is also an "Almighty Cancelling System." While the chair is in automatic operation, the emergency stop can be made instantly by pushing any of the switches.

The specifications of the present axis-type chair and integral headrest may be summarized as follows:

| | |
|---|---|
| Base Up and Down System | Electric-powered Oil Pressure Canti-Lever System |
| Base Stroke | 380 mm (the lowest height 420 mm, the maximum height 800 mm) |
| Angle of Backrest | 70° at standing, 0° at the maximum declivity |
| Tilt System | Reclining Linkage Tilt (Legrest Linkage) |
| Angle of Tilt | 13° at standing, 25° at maximum declivity |
| Rotating Headrest | Oil Pressure Electric-powered Rotating or Up and Down System for Absorption of Sitting Height Difference |
| Angle of Rotating Headrest | 40° (5° forward, 35° backward) |
| Confines of Up and Down Motion of the Headrest | 90 mm |
| Armrest | Rotating System with Opening on the Side |
| Chair Control | Low Voltage (DC 12 V) Electronic Control Circuit |
| Pre-Set System | Cancelling can be done by All Switches |
| Material of Seat, Backrest, and Arm Covers | Vinyl Leather |
| Base Material | Cast Iron |
| Gross Weight | 136 kg |
| Option-Foot Switch | Switch for up and Down of Seat and for Raising and Lowering of the Backrest |

In one embodiment of the invention, the present chair for human dental or medical treatment and having an improved adjustable headrest support includes a chair per se, the chair having a frame; a seat for receiving and supporting the body of a human patient, the seat being mounted and supported on the frame; a headrest for receiving the head of the human patient; a flat, curved, linear, strip member, one end of the strip member being attached to the headrest, the strip member extending from the frame to the headrest, so that the headrest is supported by the strip member and the frame, and at least one pair of opposed cylindrical guide rollers, the rollers straddling the strip member and extending contiguously across the surface of the strip member substantially transverse to the linear longitudinal axis of the strip member, so as to guide the motion of the strip member along the longitudinal axis. Typically, this embodiment of the invention includes a principal hydraulic mechanism, the principal mechanism including a principal fluid pressure cylinder pivotally linked at one end to the frame by a first transverse supporting shaft, the cylinder containing a piston plunger having a piston head, the outer end of the piston plunger being pivotally attached to the other end of the strip member by a second transverse supporting shaft, and means to pass a hydraulic fluid into the cylinder, so that the piston head and piston plunger may be displaced in the cylinder, and so that the elevation of the headrest, and the position of the headrest relative to the seat, may be altered. This embodiment of the invention is completed by the provision of at least one tension spring, the spring extending between the first shaft and the second shaft, to produce smooth backdown of the piston plunger and piston head when fluid pressure in the cylinder is reduced.

Typically, two pairs of opposed cylindrical guide rollers are provided in tandem along the strip member, and two tension springs are provided on opposite sides of the cylinder.

In a preferred embodiment of the invention, a second hydraulic mechanism is provided. This second hydraulic mechanism includes a second fluid pressure cylinder pivotally linked at one end to the frame by a third transverse supporting shaft, the third shaft being mounted at each end directly to the frame, so that the third shaft is rotatable about its central longitudinal axis. The second cylinder contains a second piston plunger having a second piston head, the outer end of the second piston plunger being pivotally attached to the first transverse supporting shaft, so that the second hydraulic mechanism is pivotally linked to the principal hydraulic mechanism. Means is provided to pass a hydraulic fluid into the second cylinder, so that the second piston head and piston plunger may be displaced in the second cylinder, and thereby concomitantly the first shaft and principal hydraulic mechanism may be displaced relative to the frame. At least one auxiliary tension spring is also provided, this auxiliary spring extending between the third shaft and the first shaft, to produce smooth backdown of the second piston plunger and second piston head when fluid pressure in the second cylinder is reduced. Typically in this embodiment, the cylinders of the principal and second hydraulic mechanisms are coaxial, and two auxiliary tension springs are provided on opposite sides of the second cylinder. In addition, preferably the flat curved linear strip member is in the shape of a circular arc.

In a more general embodiment of the invention, what is contemplated is a chair for human dental or medical treatment and having an improved adjustable headrest support, which includes a chair per se, the chair having a frame, a seat for receiving and supporting the body of a human patient, the seat being mounted and supported on the frame, a headrest for receiving the head of the human patient, a flat curved linear strip member, one end of the strip member being attached to the headrest, the strip member extending from the frame to the headrest, so that the headrest is supported by the strip member and the frame, and two spaced-apart pairs of opposed cylindrical guide rollers in tandem, the guide rollers in each pair straddling the strip member and extending contiguously across the surface of the strip member substantially transverse to the linear longitudinal axis of the strip member, so as to guide the motion of the strip member along the longitudinal axis, whereby to make possible the vertical direction of movement of the strip member. Finally, means is provided and mounted to the frame to displace the strip member along its longitudinal axis, and towards or away from the frame. In a preferred embodiment, typically the aforementioned means entails the provision of a hydraulic mechanism including a fluid pressure cylinder containing a piston plunger having a piston head, the outer end of the piston plunger being pivotally attached to the other end of the strip member. Typically in this embodiment of the invention, the flat curved linear strip member is in the shape of a circular arc.

The invention accordingly consists in the features of construction, combination of elements, and arrangement of parts, which will be exemplified in the device and article of manufacture hereinafter described, and of which the scope of application is as elucidated supra and as will be indicated in the appended claims.

BRIEF DESCRIPTION OF THE DRAWINGS

Simple Explanation of the Figures

The figures are an example headrest for medical chair of this invention: The FIG. 1 is the cross section of side view: The FIG. 2 is the cross section of front view: The FIG. 3 is the cross section of III—III line of the above.

Figures 1, 2, 3:
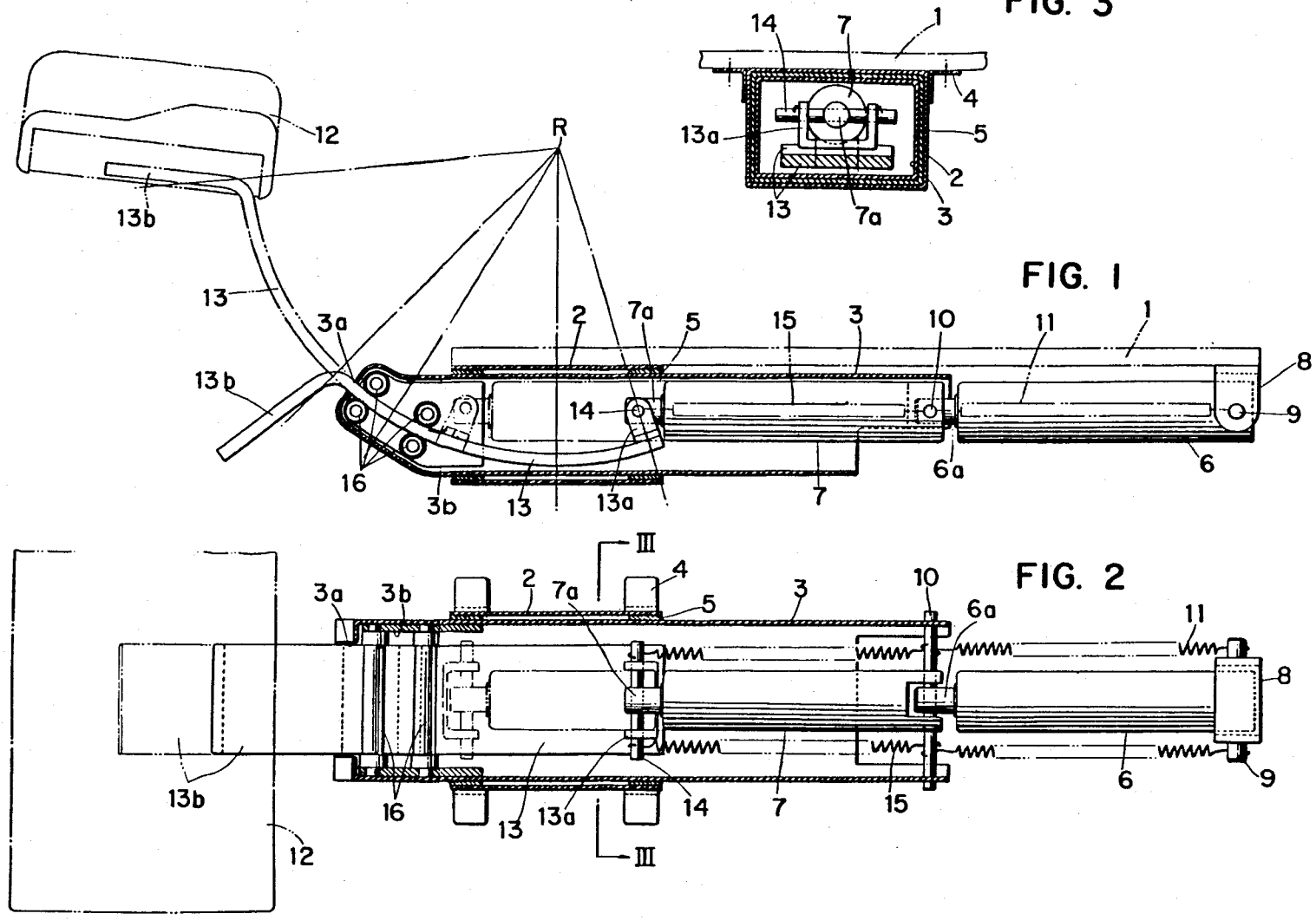

1. backrest supporting foundation plate
3. vertical motion race
6. oil pressure cylinder for vertical race
7. oil pressure cylinder for headrest
*7a*. plunger
12. headrest
13. headrest supporting plate
16. guide roller

DETAILED DESCRIPTION OF THE PREFERRED EMBODIMENTS

Next, here is an example capable of attaining abovementioned objectives of this device explained in detail with a figure attached. (Note: Because of the width of paper, the figure shown is stretching to horizontally, but actually, it is longer to vertical direction.)

The 1 is the foundation plate; the 2 is the guide race; the 3 indicates the vertical motion race; and the foundation plate 1 is used as backrest. That is, in the FIG. 1 and 3, the cushion material and its outer seat are set up on top of the foundation plate 1, forming the backrest. The guide race 2 is firmly fixed to the upper part of the back of foundation plate 1 with angle material 4, and to this guide race 2, the vertical motion race 3 is inserted with sleeve 5, making its vertical direction of movement possible.

The 6 is the oil pressure cylinder for the vertical motion race; the 7 indicates the oil pressure cylinder for headrest; and the lower part of the oil pressure cylinder for headrest; and the lower part of the oil pressure cylinder 6 for the vertical motion race is fixed to the mounting race 8 which is firmly fixed to the lower part of the back of foundation plate 1 with a supporting rod 9. To the plunger *6a* of oil pressure cylinder 6 for the vertical motion race, a supporting shaft 10 flanked to the vertical motion race 3 is inserted, and to the said supporting shaft 10, the lower part of oil pressure cylinder 7 for the headrest is set up, making its movement possible. And, between the supporting rod 9 and the supporting shaft 10, a tension spring 11 is being stretched.

The 12 is the headrest; the 13 indicates the headrest supporting plate; at the foundation of said headrest supporting plate 13, a bearing race *13a* is firmly fixed; said bearing race *13a* is set up to the horizontal shaft 14 flanked to the plunger *7a* of oil pressure cylinder 7 for the headrest, making its movement possible; and between the horizontal shaft 14 and the aforementioned supporting shaft 10, a tension spring 15 is being stretched.

The cervical vertebrae as its virtual supporting point R, the main part of the headrest supporting plate 13 is formed into a circular arc with the exception of *13b* where the headrest be attached, and this main part is inserted into a slot *3a* made at the upper part of vertical motion race 3, making it possible to be folded up. Also, the headrest supporting plate 13 is constructed so that several places of its front and rear are to be folded up into the vertical motion race 3 guided by several guide rollers 16 which are fixed at the side with the bearing *3b*.

In the construction described, the backrest foundation plate 1 is raised up and lowered down to the underseat as did the medical treatment chair known in the past. And according to the movement of the plunger *6a* of the oil pressure cylinder 6 for the vertical motion race, the vertical motion race 3 makes the vertical motion, and according to the movement of plunger *7a* of the oil pressure cylinder 7 for the headrest, the headrest supporting plate 13 makes the movement; however, the headrest 12 is in rising position when the headrest supporting plate 13 is out and when it is in, the headrest 12 is in tilted position. And, as mentioned, the headrest supporting plate 13 is formed into a circular arc, and for this object of circular arc, moving the cervical vertebrae of patient as its virtual supporting point R not only when it is in motion but also when it is tilted, makes possible to obtain the changing of position to be comfortable regardless of the various positions. The tension springs 11 and 15 are, of course, to facilitate the backdown of the plungers 6*a* and 7*a* smoothly as does the oil pressure cylinder.

This device is not restricted only to this; for example, the oil pressure cylinder 7 for the headrest can be set up directly to the backrest foundation plate 1 without the oil pressure cylinder 6 for the vertical motion race and the vertical motion race 3. By thus doing, reduction of the initial as well as the running costs can be made by the simplification of construction.

It thus will be seen that there is provided a headrest for a medical or dental treatment chair, and an adjustable chair for human dental or medical treatment, which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above is presented merely as an example of the invention. Other embodiments, forms and modifications of the invention, coming within the proper scope and spirit of the appended claims, will of course readily suggest themselves to those skilled in the art. Thus, while there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A chair for human dental or medical treatment and having an improved adjustable headrest support, which comprises:

a. a chair, said chair having a frame, b. a seat, mounted on said frame;

c. a headrest;

d. a bearing race rotatably mounted to a first transverse supporting shaft, e. a flat curved strip member, one end of said strip member being attached to said headrest, said strip member defining part of a circle, and means mounting said strip member for circular movement around the center of the circle, the other end of said strip member being attached to said bearing race, whereby movement of said strip member corresponds to the natural movement of a human neck, f. said mounting means comprising at least one pair of opposed cylindrical guide rollers on said frame, said rollers straddling said strip member and extending contiguously across the surface of said strip member substantially transverse to the linear longitudinal axis of said strip member, so as to guide the motion of said strip member along said longitudinal axis, g. a hydraulic mechanism, said hydraulic mechanism comprising a fluid pressure cylinder pivotally linked at one end to said frame by a second transverse supporting shaft, said cylinder containing a piston plunger having a piston head, the outer end of said piston plunger being pivotally attached to the other end of said strip member by said first transverse supporting shaft and said bearing race, wherein said piston plunger moves in a horizontal path causing said curved strip member to move in a circular path in conjunction with said bearing race, resulting in the different positioning of said headrest without placing of a human body in a strained position, h. means to pass a hydraulic fluid into said cylinder, so that said piston head and piston plunger may be displaced in said cylinder, and said headrest may be positioned in said way;

i. a spring, said spring extending between said first shaft and said second shaft, to produce substantially smooth backdown of said piston plunger and piston head when fluid pressure in said cylinder is reduced.

2. The chair of claim 1 in which two pairs of opposed cylindrical guide rollers are provided in tandem along the strip member.

3. The chair of claim 1 in which two tension springs are provided on opposite sides of the cylinder.

4. The chair of claim 1 together with a second hydraulic mechanism, said second hydraulic mechanism comprising a second fluid pressure cylinder pivotally linked at one end to said frame by a third transverse supporting shaft, said third shaft being mounted at each end directly to said frame, so that said third shaft is rotatable about its central longitudinal axis, said second cylinder containing a second piston plunger having a second piston head, the outer end of said second piston plunger being pivotally attached to said first transverse supporting shaft, so that said second hydraulic mechanism is pivotally linked to the principal hydraulic mechanism, means to pass a hydraulic fluid into said second cylinder, so that said second piston head and piston plunger may be displaced in said second cylinder, and thereby concomitantly said first shaft and principal hydraulic mechanism may be displaced relative to the frame, and at least one auxiliary tension spring, said auxiliary spring extending between said third shaft and said first shaft, to produce smooth backdown of said second piston plunger and second piston head when fluid pressure in said second cylinder is reduced.

5. The chair of claim 4 in which the cylinders of the principal and second hydraulic mechanisms are coaxial.

6. The chair of claim 4 in which two auxiliary tension springs are provided on opposite sides of the second cylinder.

7. The chair of claim 1 in which the flat curved linear strip member is in the shape of a circular arc.

8. The chair of claim 1, having two spaced-apart pairs of opposed cylindrical guide rollers in tandem, said guide rollers in each pair straddling contiguously across the surface of said strip member substantially transverse to the linear longitudinal axis of said strip member, so as to guide the motion of said strip member in said way.

9. The chair of claim 8 in which the means of element (f) comprises a hydraulic mechanism including a fluid pressure cylinder containing a piston plunger having a piston head, the outer end of said piston plunger being pivotally attached to the other end of said strip member.

10. The chair of claim 8 in which the flat curved linear strip member is in the shape of a circular arc.

* * * * *